US006493909B2

(12) United States Patent
Paul

(10) Patent No.: US 6,493,909 B2
(45) Date of Patent: Dec. 17, 2002

(54) CONNECTOR DEVICE FOR CONNECTING TOGETHER ITEMS HAVING MISMATCHED OR INOPERATIVE CONNECTION MECHANISMS

(76) Inventor: Kenneth M. Paul, 1424 Meadowrose Dr., Golden, CO (US) 80401

( * ) Notice: Subject to any disclaimer, the term of this patent is extended or adjusted under 35 U.S.C. 154(b) by 0 days.

(21) Appl. No.: 09/800,190

(22) Filed: Mar. 6, 2001

(65) Prior Publication Data

US 2002/0129469 A1 Sep. 19, 2002

(51) Int. Cl.[7] ..... A44B 19/00
(52) U.S. Cl. ..... 24/381; 24/382
(58) Field of Search ..... 24/381, 382, 406

(56) References Cited

U.S. PATENT DOCUMENTS

| | | | | |
|---|---|---|---|---|
| 1,603,144 A | * | 10/1926 | Nichols | 24/381 X |
| 2,178,885 A | | 11/1939 | Buff et al. | |
| 2,483,057 A | * | 9/1949 | Levering | 24/382 |
| 2,971,200 A | | 2/1961 | Lindsey | |
| 4,083,089 A | * | 4/1978 | Minami | 24/381 |
| 4,112,552 A | | 9/1978 | Lee | |
| 4,510,655 A | * | 4/1985 | Asahi | 24/382 |
| 5,005,235 A | | 4/1991 | Huang | |
| 5,813,094 A | | 9/1998 | Perez, II | |
| 5,887,299 A | | 3/1999 | Phillips | |

FOREIGN PATENT DOCUMENTS

| | | |
|---|---|---|
| GB | 275868 | 10/1926 |
| GB | 482006 | 4/1937 |

* cited by examiner

*Primary Examiner*—Robert J. Sandy
(74) *Attorney, Agent, or Firm*—Donald W. Margolis; Emery L. Tracy

(57) ABSTRACT

A connecting device for connecting a first item having a connecting mechanism and a second item having a second connecting means for use when the first item connecting means is incompatibly mismatched, inoperative, non-fully functioning or otherwise unconnectable with the second item connecting mechanism. The connecting device comprises a sheet having a first edge and a second opposed edge. A first connection mechanism is secured to the first edge for connecting it to a mismatched, inoperative, non-fully functioning or otherwise unconnectable connection mechanism with the second item connection mechanism. A second connection mechanism is secured to the second edge of the first sheet member for connecting the second edge of the sheet to the second item connection mechanism, so that the first connection mechanism matches the first item connection mechanism and the second connection mechanism compatibly matches, operates, functions or is otherwise connectable with the second item connector mechanism.

28 Claims, 4 Drawing Sheets

CONNECTOR DEVICE FOR CONNECTING TOGETHER ITEMS HAVING MISMATCHED OR INOPERATIVE CONNECTION MECHANISMS

BACKGROUND OF THE INVENTION

1. Field of the Invention

This invention relates generally to a device for connecting mismatched, inoperative, non fully functioning or otherwise unconnectable connection mechanisms, and, more particularly, it relates to a connector device which allows a user to connect together items having mismatched, inoperative, non-fully functioning or otherwise unconnectable connection mechanisms, such as zippers, snaps, buttons, hook and loop connector systems, hooks, grommets, buckles and equivalent connector systems.

2. Description of the Prior Art

Many items, such as tarps, tents, awnings, sleeping bags, garments, etc., utilize various connection mechanisms, such as zippers, snaps, buttons, hook and loop connector systems, hooks, grommets, buckles and equivalent connector systems, for connecting the items to each other. Oftentimes, it is necessary or desirable to connect together items having mismatched or inoperative connecting mechanisms. Although a separate fastening mechanism, such as tape, thread, staples, and equivalent fastening systems can be used to bypass the mismatched or inoperative connecting mechanisms, it is may not be possible to connect these items together using the connection mechanisms provided with the items. Unfortunately, using such separate fastening mechanisms is time consuming, often irreversible and expensive so that many items with mismatched or inoperative connecting mechanisms are simply discarded.

Accordingly, there exists a need for a connector device for connecting together items having mismatched or inoperative connecting mechanisms. Additionally, a need exists for a connector device for connecting together items, which device connects together a variety of items having a variety of connection mechanisms. Furthermore, there exists a need for a connector device for connecting items together which is easy to use, inexpensive to produce, and avoids waste.

SUMMARY

The present invention is a connector device for connecting together a first item having a first item connecting mechanism and a second item having a second item connecting mechanism, wherein the connecting mechanisms have mismatched, inoperative, non-fully functioning or otherwise unconnectable connection mechanisms. In general, the connecting device comprises a first sheet member having a first side and a second side substantially opposite the first side, and having a first edge and a second edge substantially opposite the first edge. A first connection means is secured to the first edge of the first sheet member for connecting the first edge of the first sheet member to the first item connection mechanism. A second connection mechanism is secured to the second edge of the first sheet member for connecting the second side of the first sheet member to the second item connection mechanism. The first connection mechanism compatibly matches the first item connection mechanism and the second connection means either compatibly matches the second item connection mechanism, or otherwise overcomes the inoperative, non-fully functioning or otherwise unconnectable connection mechanisms.

The present invention further includes a connection assembly for connecting together items having mismatched, inoperative, non-fully functioning or otherwise unconnectable connection mechanisms. The connection assembly comprises a first connection mechanism securable to a first connector and a second connection mechanism spaced from the first connection mechanism, the second connection mechanism securable to a second connector on a second item to overcome problems due to the first connector being mismatched, inoperative, non-fully functioning or otherwise unconnectable connection mechanisms The present invention still further includes a method for joining together at least a first item having a first item connector and a second item having a second item connector with the first item connector being incompatibly mismatched, inoperative, non-fully functioning or otherwise unconnectable connection mechanisms with the second item connector. The method comprises providing a first sheet member having a first side and a second side substantially opposite the first side, and having a first edge and a second edge substantially opposite the first edge, securing a first connection mechanism to the first edge of the first sheet member, the first connection mechanism compatibly or operatively matching the first item connector, connecting the first connection mechanism to the first item connector, securing a second connection mechanism to the second edge of the first sheet member, the second connection mechanism compatibly or operatively matching the second item connector, and connecting the second connection mechanism to the second item connector.

DETAILED DESCRIPTION OF THE PREFERRED EMBODIMENTS

Figure 1:
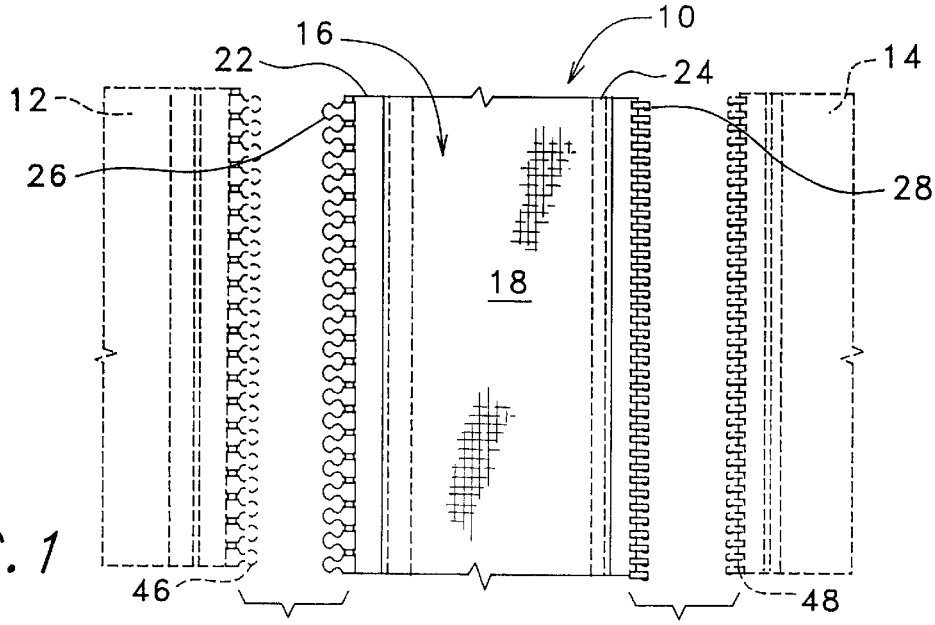
FIG. 1 is a side elevational view illustrating a connector device for connecting together items having mismatched, inoperative, non-fully functioning or otherwise unconnectable connection mechanisms with the second item connector, constructed in accordance with the present invention, with the items having mismatched zippers.

As illustrated in FIGS. 1–12, the present invention is a connector device, indicated generally at 10, for connecting together at least two items having mismatched, inoperative, non-fully functioning or otherwise unconnectable connection mechanisms. Connector device 10 of the present invention, can serve to connect together a plurality of items including, but not limited to, a first item 12 and a second item 14; and in some instances, a third item (not shown) and a fourth item (not shown); and so on. Furthermore, the items 12, 14 connected together by the connector device 10 can be chosen from a wide variety of items including, but not limited to, tarps, tents, awnings, sleeping bags, garments, and equivalent items. As detailed below, a person skilled in the art will understand that the type of items 12, 14 connectable together by the connector device 10 of the present invention are not limited in type, size, dimensions, or the like, to any item 12, 14 stated heretofore and hereafter and any discussion of a particular item should not be considered limiting to the invention as claimed below.

Referring again to FIG. 1, connector device 10 of the present invention comprises a first member 16, in this case a first sheet member having a first side 18 and a second side 20 substantially opposite the first side 18. The first sheet member 16 further includes a first edge 22 and a second edge 24 substantially opposite the first edge 22.

The first sheet member 16 is normally constructed from a fabric material, although constructing the first sheet member from other materials including, but not limited to cloth, plastic, metal, and so on, is within the scope of the present invention. Furthermore, the first member 16 can be a variety of sizes and dimensions depending on the intended use of the connector device 10.

In one embodiment of the present invention, the connector device 10 further includes a first connection mechanism 26 secured along the first edge 22 of the first sheet member 16, and a second connection mechanism 28 secured along the second edge 24 of the first sheet member 16. The first connection mechanism 26 can be substantially identical to the second connection mechanism 28, or the first connection mechanism can be different than the second connection mechanism 28. For example, as illustrated in FIG. 1, the first connection mechanism 26 can be a zipper having a first zipper type or size and the second connection mechanism 28 can be a zipper having a second zipper type or size. Similarly, connectors 26 and 28 may be not only zippers, but also snaps, buttons, hook and loop connector systems, hooks, grommets, buckles and equivalent connector systems, as the need arises.

Figure 2:
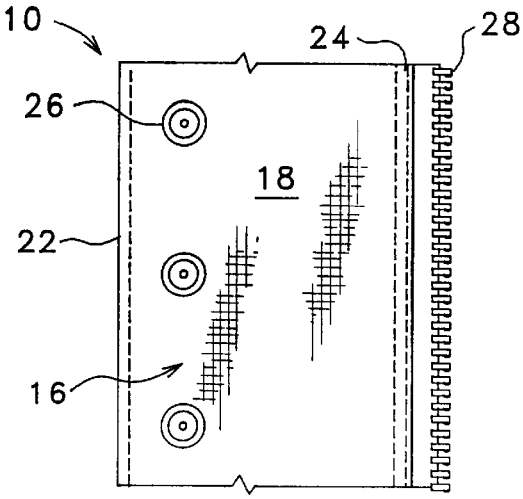
FIG. 2 is a side elevational illustrating another embodiment of the connector device for connecting together items having mismatched, inoperative, non-fully functioning or otherwise unconnectable connection mechanisms connection mechanisms, constructed in accordance with the present invention, with the connector device constructed for connecting together a first item having snaps and a second item having a zipper.

As illustrated in FIG. 2, the first connection mechanism 26 is shown as having a plurality of snaps and the second connection mechanism 28 is shown as a zipper. As detailed below, the mechanism of FIG. 2 is especially well suited for connecting an item having an inoperative connecting mechanism.

Figure 3:
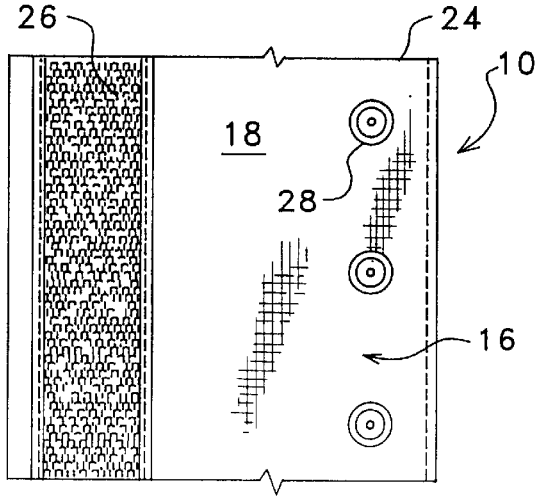
FIG. 3 is a side elevational view illustrating another embodiment of the connector device for connecting together items having mismatched, inoperative, non-fully functioning or otherwise unconnectable connection mechanisms, constructed in accordance with the present invention, with the connector device constructed for connecting together a first item having a hook and loop fastener and a second item having snaps.
Figure 8:
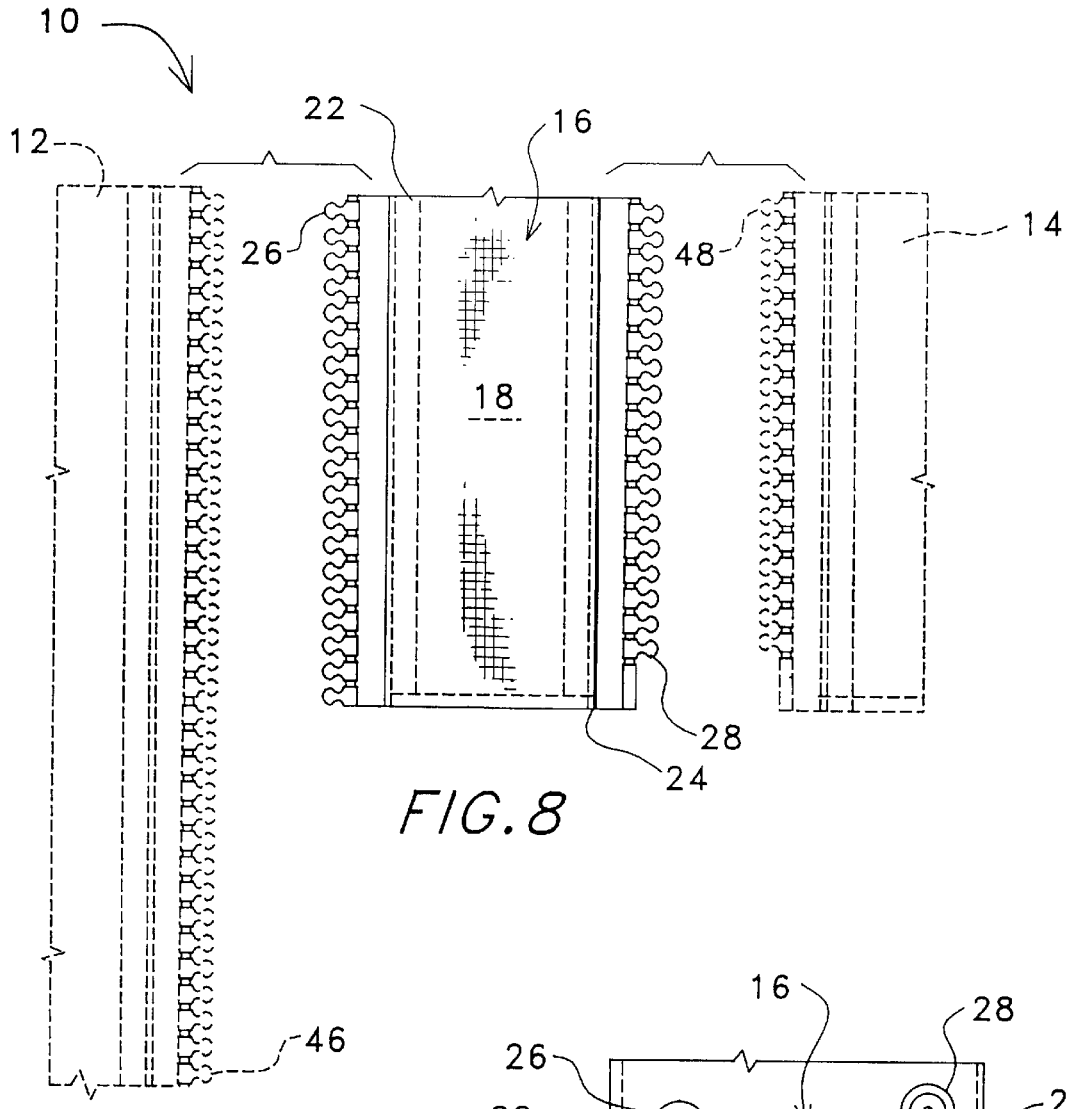
FIG. 8 is a side elevational view illustrating another embodiment of the connector device for connecting together items having mismatched, inoperative, non-fully functioning or otherwise unconnectable connection mechanisms, constructed in accordance with the present invention, with the connector device constructed for connecting together items having different lengths.

As illustrated in FIG. 3, the first connection mechanism 26 is shown as half of a VELCRO hook and loop fastener system, and the second connection mechanism 28 is shown as a plurality of snaps. As illustrated in FIG. 8, the first connection mechanism 26 is shown as a zipper having a first predetermined length and the second connection mechanism 28 is shown as a zipper having a second, but different, predetermined length.

Figure 9:
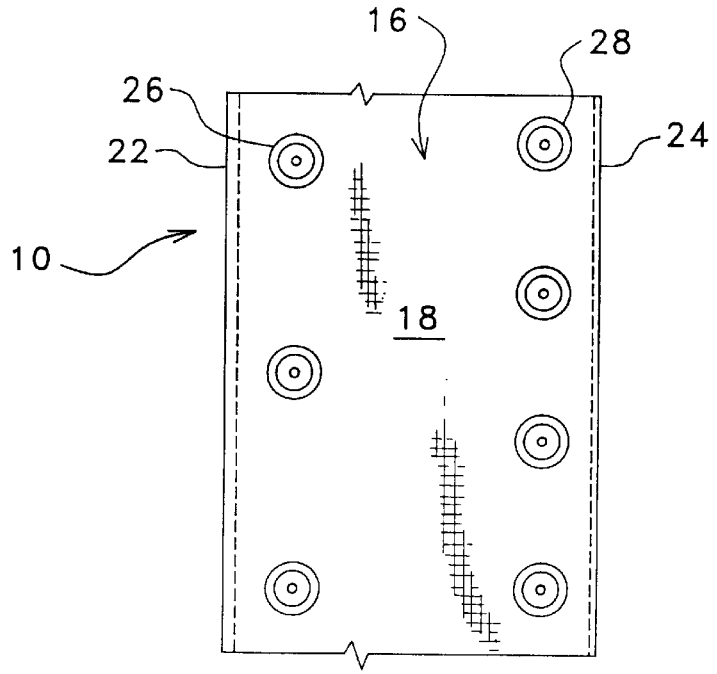
FIG. 9 is a side elevational view illustrating another embodiment of the connector device for connecting together items having mismatched, inoperative, non-fully functioning or otherwise unconnectable connection mechanisms, constructed in accordance with the present invention, with the connector device constructed for connecting together items having mismatched snaps.

As illustrated in FIG. 9, the first connection mechanism 26 is shown as a plurality of snaps having a first predetermined spacing and the second connection mechanism 28 is shown as a plurality of snaps having a second, but different, predetermined spacing. As detailed below, the mechanism of FIG. 9 is also especially well suited for connecting an item having an inoperative connecting mechanism.

Figure 10:
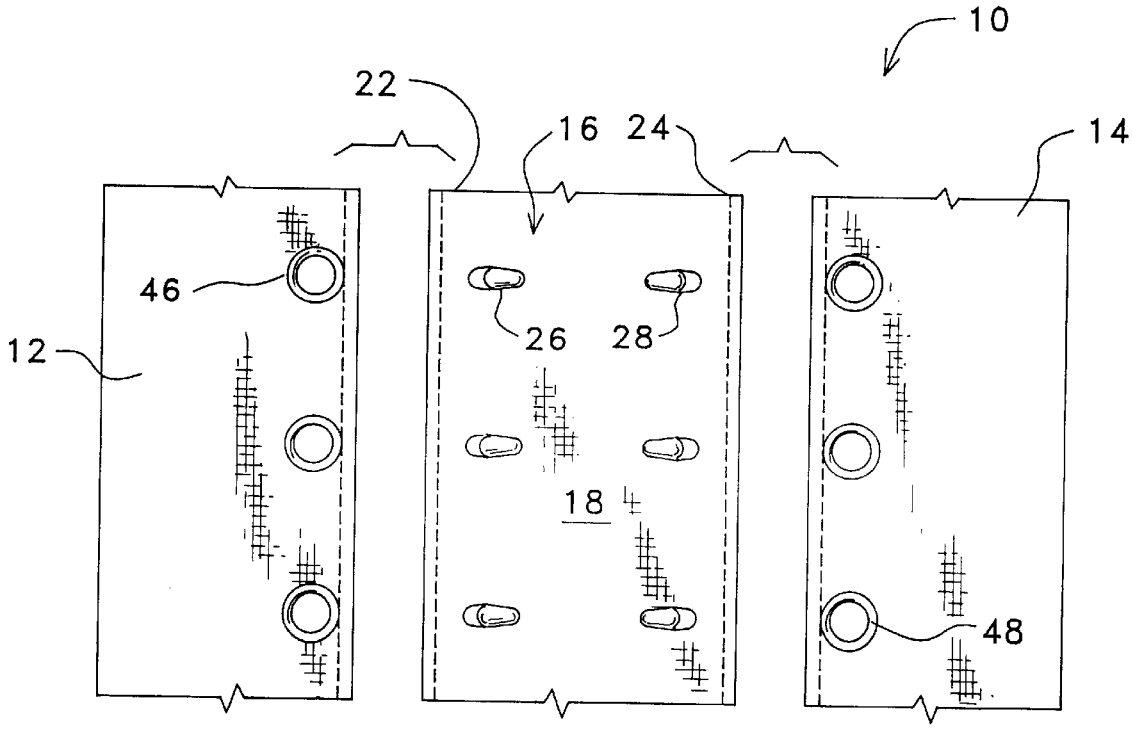
FIG. 10 is a side elevational view illustrating another embodiment of the connector device for connecting together items having mismatched, inoperative, non-fully functioning or otherwise unconnectable connection mechanisms, constructed in accordance with the present invention, with the connector device constructed for connecting together items having grommets.

As illustrated in FIG. 10, the first connection mechanism 26 is shown as a plurality of hooks having a first predetermined spacing and the second connection mechanism 28 is shown as a plurality of hooks having a second predetermined, but different, spacing. Again, connectors 26 and 28 may be not only hooks, but also snaps, buttons, hook and loop connector systems, zippers, grommets, buckles and equivalent connector systems, as the need arises.

Figure 4:
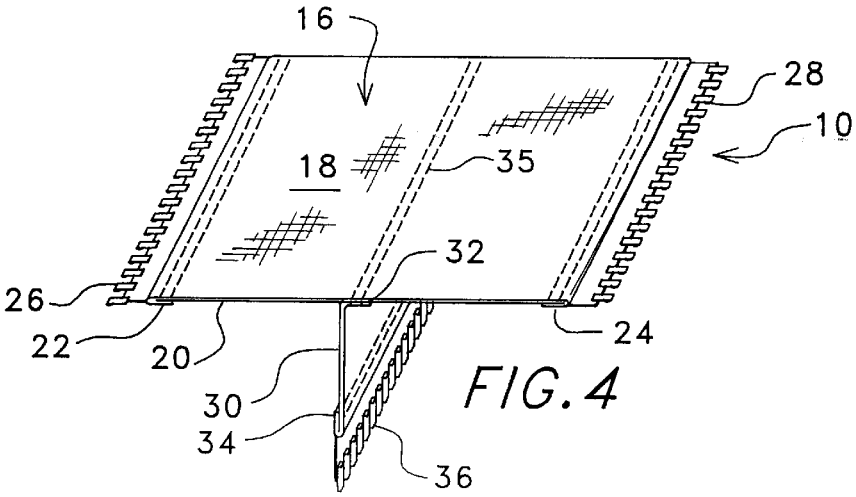
FIG. 4 is a perspective view illustrating another embodiment of the connector device for connecting together items having mismatched, inoperative, non-fully functioning or otherwise unconnectable connection mechanisms, constructed in accordance with the present invention, with the connector device constructed for connecting together three items having the same or different zippers.
Figure 5:
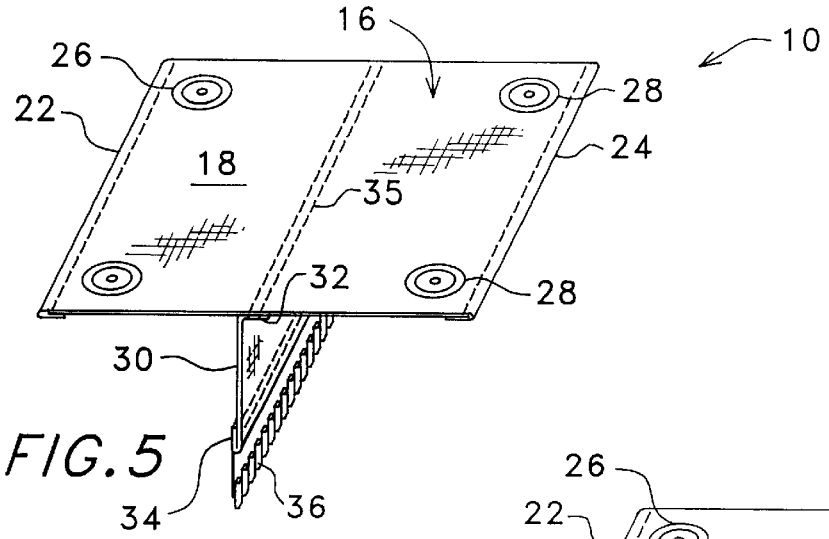
FIG. 5 is a perspective view illustrating another embodiment of the connector device for connecting together items having mismatched, inoperative, non-fully functioning or otherwise unconnectable connection mechanisms, constructed in accordance with the present invention, with the connector device constructed for connecting together a first item having snaps, a second item having snaps, and a third item having a zipper.
Figure 6:
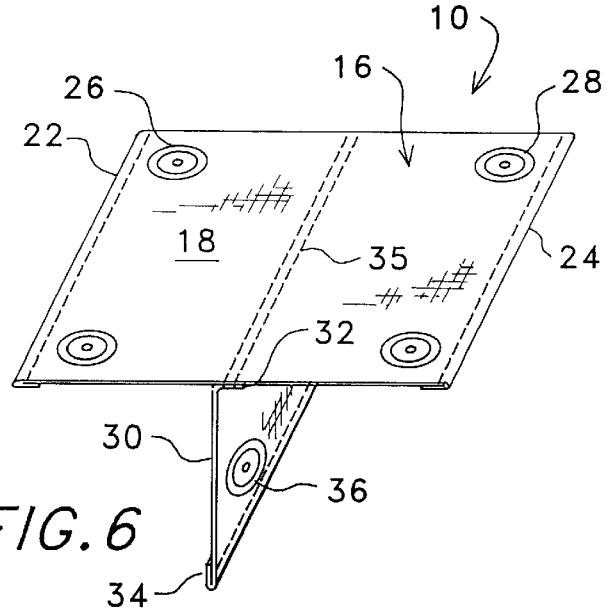
FIG. 6 is a perspective view illustrating another embodiment of the connector device for connecting together items having mismatched, inoperative, non-fully functioning or otherwise unconnectable connection mechanisms, constructed in accordance with the present invention, with the connector device constructed for connecting together three items having snaps.

As illustrated in FIGS. 4–6, in another embodiment of the present invention, the connector device 10 includes the first sheet member 16 having the first connection mechanism 26 secured along the first edge 22 of the first sheet member 16 and the second connection mechanism 28 secured along the second edge 24 of the first sheet member 16. The connector device 10 of the present invention further includes a second sheet member 30 having a first edge 32 and a second edge 34 substantially opposite the first edge 32. In accordance with the teaching of the present invention, the first edge 32 of the second sheet member 30 is secured to the first side 18 of the first sheet member 16 between the first edge 22 and the second edge 24 of the first sheet member 16. The second sheet member 30 is capable of being secured to the first sheet member 16 by a sewn thread fastening system 35. It is within the scope of the present invention; however, to secure the second sheet member 30 to the first sheet member 16 by other fastening procedures, including, but not limited to, rivets, staples, and other equivalent fastening systems.

As with the first sheet member 16, the second sheet member 30 is preferably constructed from a flexible material, such as fabric, although constructing the second sheet member 30 from other materials including, but not limited to, plastic, metal foil or metal composites, and other equivalent materials is within the scope and teaching of the present invention. The second sheet member 30 may also be a variety of sizes and dimensions depending on the intended use of the connector device 10.

As further illustrated in FIGS. 4–6, a third connection mechanism 36 is carried adjacent to the second edge 34 of the second sheet member 30. The third connection mechanism 36 may be substantially identical to the first connection mechanism 26, or to the second connection mechanism 28. In the alternative, the third connection mechanism 36 may be different than the first connection mechanism 26 or the second connection mechanism 28. As more specifically illustrated in FIG. 4, the first connection mechanism 26 is one half of a zipper system, the second connection mechanism 28 is also one half of a zipper system, and the third connection mechanism 36 is also one half of a zipper system. Of course, connectors 26 and 28 may be not only zippers, but may also be snaps, buttons, hook and loop connector systems, hooks, grommets, buckles and equivalent connector systems, as the need arises.

As further illustrated in FIG. 5, the first connection member 26 is a plurality of one half of a snap system, the second connection mechanism 28 is a plurality of one half of a snap system, and the third connection member 36 is one half of a zipper system.

As illustrated in FIG. 6, the first connection member 26 is a plurality of one half of a snap system, the second connection mechanism 28 is also a plurality of one half of a snap system, and the third connection member 36 is also a plurality of one half of a snap system. In FIGS. 5 and 6, connectors 26 and 28 may be not only be zippers and grommets, but also snaps, buttons, hook and loop connector systems, hooks, buckles and equivalent connector systems, as the need arises.

Figure 7:
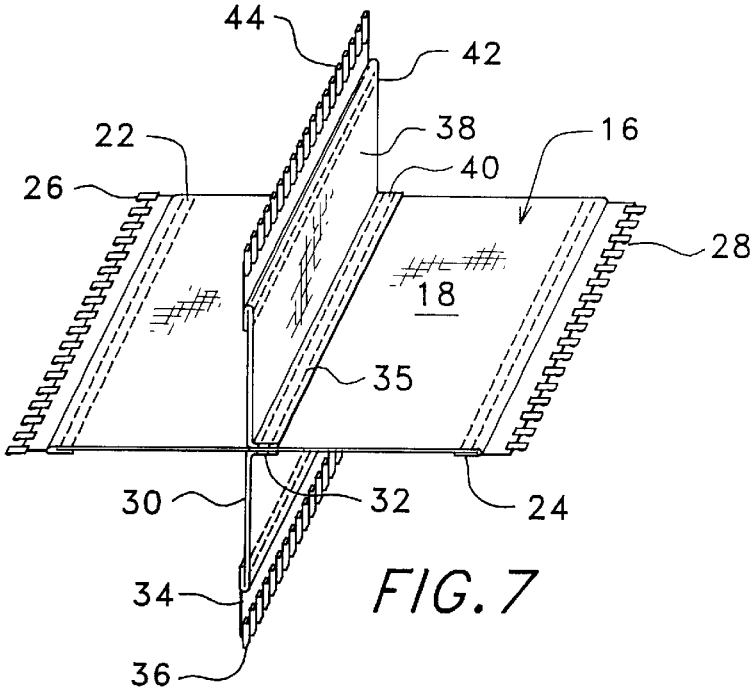
FIG. 7 is a perspective view illustrating another embodiment of the connector device for connecting together items having mismatched, inoperative, non-fully functioning or otherwise unconnectable connection mechanisms, constructed in accordance with the present invention, with the connector device constructed for connecting together four items having the same or different zippers.

As illustrated in FIG. 7, in another embodiment of the present invention, the connector device 10 includes three sheet members having four edges, with a connection mechanism carried by and adjacent each edge. Thusly, first sheet member 16 has a first connection mechanism 26 secured along the first edge 22 of the first sheet member 16, the second connection mechanism 28 is secured along the second edge 24 of the first sheet member 16, and a third connection member 36 secured along the second edge 34 of the second sheet member 30.

Referring again to FIGS. 4, 5 and 6, it is also seen, that in general the connector device 10 of the present invention may further includes a third sheet member 38 having a first edge 40 and a second edge 42 substantially opposed to the first edge 40. In accordance with the teaching of the present invention, the first edge 40 of the third sheet member 38 is secured to the second side 20 of the first sheet member 16 between the first edge 22 and the second edge 24 of the first sheet member 16. It should be noted that the third sheet member 38 may be secured to the second side 20 of the first sheet member 16 substantially opposite the second sheet member 30, or the third sheet member 38 can be secured to the second side 20 of the first sheet member 16 offset from the second sheet member 30. Similar to the second sheet member 30, the third sheet member 38 can be sewn to the first sheet member 16 by threads 35. It is within the scope of the present invention; however, to secure the third sheet member 30 to the first sheet member 16 by other fastening procedures, including, but not limited to, rivets, staples, and other equivalent fastening systems. As with the first sheet member 16 and the second sheet member 30, the third sheet member 38 is preferably constructed from a flexible fabric material, although constructing the third sheet member 38 from other materials, including, but not limited to, plastic, metal, and other equivalent materials is within the scope of the present invention. The third sheet member 38 can also be a variety of sizes and dimensions depending on the intended use of the connector device 10.

As shown in FIG. 7, a fourth connection mechanism 44 is secured adjacent to the second edge 40 of the third sheet member 38. The fourth connection mechanism 44 may be substantially identical to the first connection mechanism 26, the second connection mechanism 28, and the third connection mechanism 36, or the fourth connection mechanism 44 may be different than the first, second and third connection mechanisms 26, 28 and 36. As further illustrated in FIG. 7, the first, second and third halves of zipper system connection mechanisms 26, 28 and 36, and the fourth connection mechanism 44 may also be one half of a zipper system.

While only zippers of the same size are shown in FIGS. 4 and 7, similar three and four connector systems having zipper connectors of different sizes, or connectors other than zippers, such as snaps, buttons, hook and loop connector systems, hooks, grommets, buckles and equivalent connector systems may be used to overcome mismatched, inoperative, non-fully functioning or otherwise unconnectable connection mechanisms.

The operation of the connector device 10 of the present application is best illustrated in FIG. 1 in which it is desired to connect a first item 12 having a first item connector 46, and a second item 14 having a mismatched connector 48. First item connector 46 is similar to and compatible with the first connection mechanism 26, and is positioned adjacent the first edge 22 of the first sheet member 16. The second item 14 having a second item connector 48 similar to and compatible with the second connection mechanism 28 is positioned adjacent the second edge 24 of the second sheet member 16. Then, the first connection mechanism 26 is connected to the first item connector 46, the connection not being shown, and the second connection mechanism 28 is connected to the second item connector 48. Thereby, the connector device 10 connects the first item 12 to the second item 14, even though the first item 12 and the second item 14 have mismatched or inoperative connectors.

As evident from the description herein, the connector devices 10 of the present invention allow connection of items having mismatched, unconnectable and inoperative connection mechanisms. Additionally, the connector devices 10 of the present invention may be used to connect a variety of items having a variety of different connection mechanisms. Furthermore, the connector devices 10 of the present invention is easy to use, inexpensive, and avoids the loss of use of items having mismatched, unconnectable and inoperative connection mechanisms.

Figure 11:
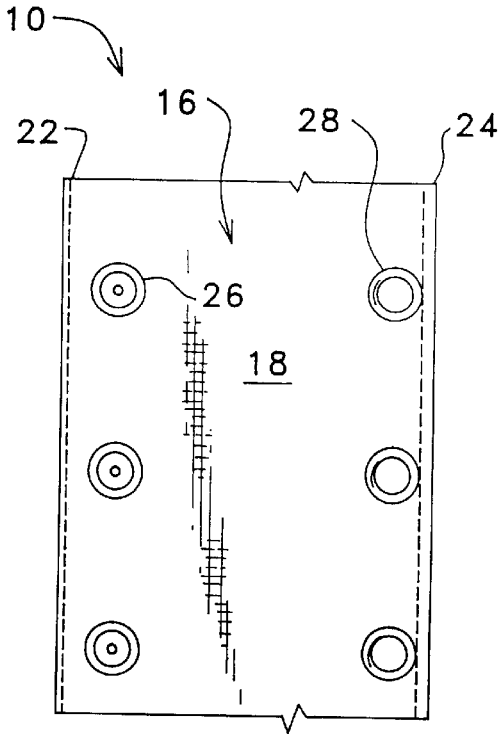
FIG. 11 is a side elevational view illustrating another embodiment of the connector device for connecting together items having mismatched, inoperative, non-fully functioning or otherwise unconnectable connection mechanisms, constructed in accordance with the present invention, with the connector device constructed for connecting to an item having snaps and grommets, as well as zippers, buttons, and hook and loop connector systems, hooks, buckles and equivalent connector systems.
Figure 12:
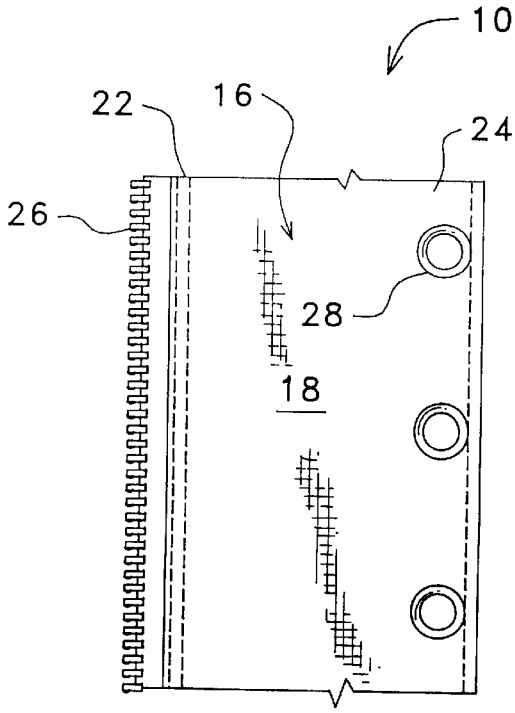
FIG. 12 is a side elevational view illustrating another embodiment of the connector device for connecting together items having mismatched, inoperative, non-fully functioning or otherwise unconnectable connection mechanisms, constructed in accordance with the present invention, with the connector device constructed for connecting to an item having zippers and grommets.

Referring now to FIGS. 11 and 12, in still another embodiment of the present invention, the connector device 10 includes only the first connection mechanism 26 secured along the first edge 22 of the first sheet member 16. As illustrated in FIG. 11, the first connection mechanism 26 comprises a plurality of snaps and the second connection mechanism 28 comprises a plurality of grommets. As illustrated in FIG. 12, the first connection mechanism 26 comprises a zipper, and the second connection mechanism 28 comprises a plurality of grommets. These embodiments of the connector device 10 of the present invention allow a user to easily and conveniently provide an attachment or extension of, for example, screening or an awning to a static structure.

The connector devices 10 illustrated in FIGS. 2–12 may be similarly used to connect first items, for example 12, to second for example items, for example 14, even though the first item 12 and the second item 14 have mismatched, inoperative, non-fully functioning or otherwise unconnectable connection mechanisms with the second item connectors. Furthermore, the current invention would be operative with other equivalent mismatched, inoperative, non-fully functioning or otherwise unconnectable connection mechanisms with the second item connectors, whether now in existence, or developed in the future.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements that are disclosed herein.

I claim:

1. A non-sliding connecting device for connecting together at least a first item having a first item connecting means and a second item having a second item connecting means, the first item connecting means being incompatibly mismatched, inoperative, non-fully functioning or otherwise unconnectable with the second item connecting means, the connecting device comprising:

a first sheet member having a first side and a second side substantially opposite said first side, and having a first edge and a second edge substantially opposite said first edge;

a first non-sliding connection means secured to said first edge of said first sheet member for connecting said first edge of said first sheet member to a first item connecting means; and a second non-sliding connection means secured to said second edge of said first sheet member for connecting said second side of said first sheet member to a second item connecting means, said second non-sliding connection means secured to said second edge of said first sheet member being incompatibly mismatched or otherwise unconnectable with said first connection means secured to said first edge of said first sheet member;

wherein said first non-sliding connection means may serve to compatibly match, operate, function or otherwise connect the first item connection means and said second connection means may serve to compatibly match, operate, functions or otherwise connect the second item connection means.

2. The non-sliding connecting device of claim 1 wherein said first non-sliding connection means is selected from the group consisting of a zippers, snaps, hook and loop connector systems, hooks, grommets and buckles.

3. The non-sliding connecting device of claim 1 wherein said second non-sliding connection means is selected from the group consisting of zippers, snaps, hook and loop connector systems, hooks, grommets and buckles.

4. The non-sliding connecting device of claim 1 and further comprising:

a second member having a first edge and a second edge, said first edge of said second member being secured to said first side of said first member between said first edge of said first member and said second edge of said first member.

5. The non-sliding connecting device of claim 4 wherein said second member includes third non-sliding connection means secured along said second edge of said second member for connecting said third connection means to a third connection means of a third item.

6. The non-sliding connecting device of claim 5 wherein said third non-sliding connection means is selected from the group consisting of zippers, snaps, buttons, hook and loop connector systems, hooks, grommets and buckles.

7. The non-sliding connecting device of claim 1 and further comprising:

a third member having a first edge and a second edge, said first edge of said third member being secured to said second side of said first member between said first edge of said first member and said second edge of said first member.

8. The non-sliding connecting device of claim 7 wherein said third member is secured to said first member substantially opposite said second side.

9. The non-sliding connecting device of claim 7 wherein said third member includes fourth non-sliding connection means secured along said second edge of said third member for connecting said fourth connection means to a fourth connection means of a fourth item.

10. The non-sliding connecting device of claim 9 wherein said fourth non-sliding connection means is selected from the group consisting of zippers, snaps, hook and loop connector systems, hooks, grommets and buckles.

11. A non-sliding connection assembly for connecting together items having mismatched connectors, the connection assembly comprising:

a first non-sliding connection means securable to a first connector carried by a first item; and a second non-sliding connection means spaced from said first connection means, said second non-sliding connection means securable to a second connector carried by a second item, said second non-sliding connection means being incompatibly mismatched or otherwise unconnectable with said first non-sliding connection means secured to said first edge of said first sheet member.

12. The non-sliding connection assembly of claim 11 wherein said first non-sliding connection means is selected from the group consisting of zippers, snaps, hook and loop connector systems, hooks, grommets and buckles.

13. The non-sliding connection assembly of claim 11 wherein said second non-sliding connection means is selected from the group consisting of zippers, snaps, hook and loop connector systems, hooks, grommets and buckles.

14. The non-sliding connection assembly of claim 11 and further comprising a third non-sliding connection means securable to a third connector on a third item.

15. The non-sliding connection assembly of claim 14 wherein said third non-sliding connection means is selected from the group consisting of zippers, snaps, hook and loop connector systems, hooks, grommets and buckles.

16. The non-sliding connection assembly of claim 11 and further comprising a fourth non-sliding connection means securable to a fourth connector on a fourth item.

17. The non-sliding connection assembly of claim 16 wherein said second non-sliding connection means is selected from the group consisting of zippers, snaps, hook and loop connector systems, hooks, grommets and buckles.

18. A method for joining together at least a first item having a first item connector and a second item having a second item connector, said first item connector being incompatibly mismatched from said second item connector, the method comprising:

providing a first member having a first side and a second side substantially opposite said first side, and having a first edge and a second edge substantially opposite said first edge;

securing a first non-sliding connection means to said first edge of said first member, said first non-sliding connection means compatibly matching said first item connector;

connecting said first non-sliding connection means to said first item connector;

securing a second non-sliding connection means to said second edge of said first member, said second non-sliding connection means compatibly matching said second item connector, but said second non-sliding connection means being incompatibly mismatched or otherwise unconnectable with said first non-sliding connection means; and connecting said second non-sliding connection means to said second item connector.

19. The method of claim 18 and further comprising:

selecting said first non-sliding connection means from the group consisting of zippers, snaps, hook and loop connector systems, hooks, grommets and buckles.

20. The method of claim 18 and further comprising:

selecting said second non-sliding connection means from the group consisting of zippers, snaps, hook and loop connector systems, hooks, grommets and buckles.

21. The method of claim 18 and further comprising:

providing a second member having a first edge and a second edge; and securing said first edge of said second member to said first side of said first member between said first edge of said first member and said second edge of said first member.

22. The method of claim 21 and further comprising:

providing a third item having a third connector;

securing a third non-sliding connection means along said second edge of said second member; and connecting said third non-sliding connection means to said third connector of said third item.

23. The method of claim 22 and further comprising:

selecting said third non-sliding connection means from the group consisting of zippers, snaps, hook and loop connector systems, hooks, grommets and buckles.

24. The method of claim 22 and further comprising:

providing a third member having a first edge and a second edge;

securing said first edge of said third member to said second side of said first member between said first edge of said first member and said second edge of said first member.

25. The method of claim 24 and further comprising:

securing said third member to said first member substantially opposite said second member.

26. The method of claim 24 and further comprising:

providing a fourth item having a fourth connector;

securing a fourth non-sliding connection means along said second edge of said third member; and connecting said fourth non-sliding connection means to said fourth connector of said fourth item.

27. The method of claim 26 and further comprising:

selecting said fourth non-sliding connection means from the group consisting of zippers, snaps, hook and loop connector systems, hooks, grommets and buckles.

28. A non-sliding connecting device for connecting together at least a first item having a first item connecting means, a second item having a second item connecting means, and a third item having a third item connecting means, the first item connecting means being incompatibly mismatched, inoperative, non-fully functioning or otherwise unconnectable with at least the second item connecting means, the non-sliding connecting device comprising:

a first sheet member having a first side and a second side substantially opposite said first side, and having a first edge and a second edge substantially opposite said first edge;

a first non-sliding connection means secured to said first edge of said first sheet member for connecting said first edge of said first sheet member to the first item connecting means; and a second non-sliding connection means secured to said second edge of said first sheet member for connecting said second side of said first sheet member to the second item connecting means, said second non-sliding connection means secured to said second edge of said first sheet member being incompatibly mismatched or otherwise unconnectable with said first non-sliding connection means secured to said first edge of said first sheet member;

a second member having a first edge and a second edge, said first edge of said second member being secured to said first side of said first member between said first edge of said first member and said second edge of said first member, second member having non-sliding connection means secured along said second edge of said second member for connecting said third non-sliding connection means to a third connection means of a third item;

wherein said first non-sliding connection means may serve to compatibly match, operate, functions or otherwise connect the first item connection means and said second non-sliding connection means may serve to compatibly match, operate, functions or otherwise connect the second item connection means.

* * * * *